US010215436B1

(12) United States Patent
Rawski

(10) Patent No.: US 10,215,436 B1
(45) Date of Patent: Feb. 26, 2019

(54) FULL SPECTRUM UNIVERSAL CONTROLLER

(76) Inventor: John M. Rawski, Plymouth, MN (US)

( * ) Notice: Subject to any disclaimer, the term of this patent is extended or adjusted under 35 U.S.C. 154(b) by 1625 days.

(21) Appl. No.: 13/462,227

(22) Filed: May 2, 2012

Related U.S. Application Data

(60) Provisional application No. 61/481,382, filed on May 2, 2011.

(51) Int. Cl.
*F24F 11/46* (2018.01)
*F24F 11/86* (2018.01)

(52) U.S. Cl.
CPC ..... *F24F 11/46* (2018.01); *F24F 11/86* (2018.01)

(58) Field of Classification Search
None
See application file for complete search history.

(56) References Cited

U.S. PATENT DOCUMENTS

| | | | | |
|---|---|---|---|---|
| 4,292,813 | A * | 10/1981 | Paddock | F25B 49/02 165/269 |
| 4,806,833 | A * | 2/1989 | Young | 318/400.08 |
| 4,856,286 | A * | 8/1989 | Sulfstede | F25B 13/00 318/811 |
| 4,953,578 | A | 9/1990 | Kautz | |
| 5,170,935 | A | 12/1992 | Federspiel et al. | |
| RE34,202 | E | 3/1993 | Kautz | |
| 5,464,369 | A | 11/1995 | Federspiel | |
| 5,485,878 | A | 1/1996 | Derks | |
| 5,550,752 | A | 8/1996 | Federspiel | |
| 5,654,598 | A | 8/1997 | Horski | |
| 5,675,206 | A | 10/1997 | Horski | |
| 5,699,857 | A | 12/1997 | Flaishans et al. | |
| 5,768,121 | A | 6/1998 | Federspiel | |
| 5,844,338 | A | 12/1998 | Horski | |
| 5,862,982 | A | 1/1999 | Federspiel | |
| 5,875,109 | A | 2/1999 | Federspiel | |
| 5,898,988 | A | 5/1999 | Horski | |
| 5,920,478 | A | 7/1999 | Ekblad et al. | |
| 6,170,480 | B1 | 1/2001 | Melink et al. | |
| 6,179,214 | B1 | 1/2001 | Key et al. | |
| 6,260,914 | B1 | 7/2001 | Nieminski et al. | |

(Continued)

FOREIGN PATENT DOCUMENTS

| | | |
|---|---|---|
| EP | 0 498 855 B1 | 4/1994 |
| EP | 0 501 432 B1 | 9/1994 |

(Continued)

*Primary Examiner* — Robert E Fennema
(74) *Attorney, Agent, or Firm* — Christensen, Fonder, Dardi & Herbert PLLC

(57) ABSTRACT

A universal controller for control of air handling and HVAC equipment. The base controller includes a fixed task portion as well as a modular portion for expansion of control features with modules. The fixed task portion is suitable for enclosure or cabinet control. The modular portion enables expansion from basic cabinet control to more complex control schemes. In one embodiment, the base controller is provided in a kit including appurtenances such as variable speed drives that enable proportional-type control of a residential air conditioning system. In another embodiment, a plurality of modules are ganged together in a rotating master/slave arrangement to distribute wear on the respective controlled air conditioning equipment.

6 Claims, 5 Drawing Sheets

(56) References Cited

U.S. PATENT DOCUMENTS 6,330,806 B1 12/2001 Beaverson et al.
6,557,574 B2 5/2003 Federspiel
6,663,010 B2 12/2003 Chene et al.
6,719,625 B2 4/2004 Federspiel
6,787,756 B2 9/2004 Tatum et al.
6,801,013 B2 10/2004 Woodward et al.
6,865,449 B2 3/2005 Dudley
6,882,124 B2 4/2005 Waite
6,936,989 B2 8/2005 Hogan
6,952,088 B2 10/2005 Woodward et al.
6,976,911 B2 12/2005 Lanham et al.
6,988,670 B2 1/2006 Keen et al.
7,007,856 B2 3/2006 La Falce et al.
7,040,686 B2 5/2006 Kapteyn
7,058,477 B1 6/2006 Rosen
7,089,087 B2 8/2006 Dudley
7,097,111 B2 8/2006 Riley et al.
7,117,129 B1 10/2006 Bash et al.
7,163,158 B2 1/2007 Rossi et al.
7,272,302 B2 9/2007 Woodward et al.
7,275,379 B2 10/2007 Zeng et al.
7,309,970 B2 12/2007 Gao
7,363,094 B2 4/2008 Kumar
7,370,500 B2 5/2008 Kapteyn
7,510,126 B2 3/2009 Rossi et al.
7,537,172 B2 5/2009 Rossi et al.
7,543,632 B2 6/2009 Pettitt et al.
7,578,135 B2 8/2009 Mattheis
7,664,573 B2 2/2010 Ahmed
7,705,722 B2 4/2010 Shoemaker et al.
7,775,452 B2 8/2010 Shah et al.
7,839,275 B2 11/2010 Spalink et al.
7,844,764 B2 11/2010 Williams
7,847,681 B2 12/2010 Singhal et al.
7,953,518 B2 5/2011 Kansal et al.
7,965,174 B2 6/2011 Wong et al.
8,036,816 B2 10/2011 Oakes
8,170,720 B2 * 5/2012 Amundson et al. ..... 700/276
2002/0020446 A1 2/2002 Federspiel
2002/0053978 A1 5/2002 Peterson et al.
2002/0084900 A1 7/2002 Peterson et al.
2002/0096572 A1 7/2002 Chene et al.
2002/0123896 A1 9/2002 Diez et al.
2002/0148944 A1 10/2002 Tatum et al.
2003/0064676 A1 4/2003 Federspiel
2003/0080706 A1 5/2003 Waite
2003/0205360 A1 11/2003 Larson
2003/0230280 A1 12/2003 Allston et al.
2004/0026998 A1 2/2004 Henriott et al.
2004/0027087 A1 2/2004 Hogan
2004/0066160 A1 4/2004 Woodward et al.
2004/0067049 A1 4/2004 Woodward et al.
2004/0067050 A1 4/2004 Woodward et al.
2004/0143810 A1 7/2004 Ahmed et al.
2004/0144107 A1 7/2004 Breton et al.
2004/0145208 A1 7/2004 Kapteyn
2004/0182097 A1 9/2004 La Falce et al.
2004/0187508 A1 9/2004 Chan
2004/0214518 A1 10/2004 Lanham et al.
2005/0050927 A1 3/2005 Kapteyn
2005/0060974 A1 3/2005 Palmerton et al.
2005/0090915 A1 * 4/2005 Geiwitz ..... 700/90
2005/0125083 A1 6/2005 Kiko
2005/0145705 A1 7/2005 Shah et al.
2005/0234616 A1 10/2005 Oliver et al.
2005/0279110 A1 12/2005 Zeng et al.
2006/0108432 A1 5/2006 Mattheis
2006/0111795 A1 5/2006 Butler et al.
2006/0116067 A1 6/2006 Federspiel
2006/0124759 A1 6/2006 Rossi et al.
2006/0137923 A1 6/2006 Larson
2006/0206291 A1 9/2006 Bash et al.
2006/0234621 A1 10/2006 Desrochers et al.
2006/0244289 A1 11/2006 Bedro
2007/0006124 A1 1/2007 Ahmed et al.
2007/0131786 A1 6/2007 Rossi et al.
2007/0131787 A1 6/2007 Rossi et al.
2007/0157631 A1 7/2007 Huang et al.
2007/0161286 A1 7/2007 Pettitt et al.
2007/0194735 A1 8/2007 Gao
2007/0203618 A1 8/2007 McBride et al.
2007/0233323 A1 10/2007 Wiemeyer et al.
2008/0186158 A1 8/2008 Shoemaker et al.
2009/0017986 A1 1/2009 Oakes
2009/0058376 A1 3/2009 Sigrist
2009/0088902 A1 4/2009 Williams
2009/0130966 A1 5/2009 Tucker
2009/0138124 A1 5/2009 Takach et al.
2009/0140060 A1 6/2009 Stoner et al.
2009/0140065 A1 * 6/2009 Juntunen et al. ..... 236/1 C
2009/0163140 A1 6/2009 Packham et al.
2009/0208333 A1 8/2009 Smith et al.
2009/0211732 A1 8/2009 Goenka
2009/0219145 A1 9/2009 Wong et al.
2009/0222139 A1 9/2009 Federspiel
2009/0266091 A1 * 10/2009 Tolbert, Jr. ..... 62/115
2010/0037644 A1 2/2010 Ward
2010/0044449 A1 2/2010 Tessier
2010/0063644 A1 3/2010 Kansal et al.
2010/0083356 A1 4/2010 Steckley et al.
2010/0106331 A1 4/2010 Li et al.
2010/0106362 A1 4/2010 Major et al.
2010/0190429 A1 7/2010 Dage
2010/0219258 A1 9/2010 Starcic
2010/0219259 A1 9/2010 Starcic
2010/0241245 A1 9/2010 Wiemeyer et al.
2010/0254852 A1 10/2010 Metteer
2010/0262357 A1 10/2010 Dupuis et al.
2010/0280836 A1 11/2010 Lu et al.
2011/0016915 A1 1/2011 Rockenfeller et al.
2011/0018472 A1 1/2011 Rockenfeller et al.
2011/0061415 A1 3/2011 Ward
2011/0083454 A1 * 4/2011 Kopko et al. ..... 62/115
2011/0085917 A1 4/2011 Ward
2011/0087988 A1 4/2011 Ray et al.
2011/0094292 A1 4/2011 Liu
2011/0106374 A1 5/2011 Margol et al.
2011/0111700 A1 5/2011 Hackett
2011/0121599 A1 5/2011 Goupil, Jr. et al.
2011/0185895 A1 8/2011 Freen
2011/0193680 A1 8/2011 Summerford et al.
2011/0219787 A1 * 9/2011 Keen et al. ..... 62/56
2011/0238223 A1 9/2011 Narayanamurthy et al.
2011/0257795 A1 10/2011 Narayanamurthy et al.
2011/0262285 A1 10/2011 Ward
2011/0269387 A1 11/2011 Leffert et al.
2012/0029729 A1 2/2012 Weslati et al.
2012/0046792 A1 2/2012 Secor
2012/0061068 A1 3/2012 Anderson et al.
2012/0072029 A1 3/2012 Persaud et al.
2012/0072030 A1 3/2012 Elliott
2012/0077426 A1 3/2012 Dage
2013/0312439 A1 * 11/2013 Howell ..... 62/89

FOREIGN PATENT DOCUMENTS

EP 1 183 177 A1 3/2002
EP 1 183 177 B1 4/2004
EP 1 726 513 A1 11/2006
EP 1 806 246 A1 7/2007
EP 2 331 819 A1 6/2011
WO WO 1991/006898 A1 5/1991
WO WO 1995/027635 A1 10/1995
WO WO 2000/071407 A1 11/2000
WO WO 2001/41628 A2 6/2001
WO WO 2001/046780 A2 6/2001
WO WO 2002/069059 A2 9/2002
WO WO 2004/034548 A2 4/2004
WO WO 2005/028078 A2 3/2005
WO WO 2005/047990 A2 5/2005
WO WO 2005/067619 A2 7/2005
WO WO 2006/020782 A2 2/2006
WO WO 2006/065834 A2 6/2006
WO WO 2006/081367 A2 8/2006

(56) References Cited

FOREIGN PATENT DOCUMENTS

| | | | |
|---|---|---|---|
| WO | WO 2006/099337 | A2 | 9/2006 |
| WO | WO 2008/108751 | A2 | 9/2008 |
| WO | WO 2009/011809 | A1 | 1/2009 |
| WO | WO 2009/065104 | A1 | 5/2009 |
| WO | WO 2009/111708 | A1 | 9/2009 |
| WO | WO 2009/132425 | A1 | 11/2009 |
| WO | WO 2010/019747 | A1 | 2/2010 |
| WO | WO 2010/037126 | A2 | 4/2010 |
| WO | WO 2010/115186 | A1 | 10/2010 |
| WO | WO 2011/075324 | A1 | 6/2011 |

* cited by examiner

FULL SPECTRUM UNIVERSAL CONTROLLER

RELATED APPLICATIONS

This application claims the benefit of U.S. Provisional Patent Application No. 61/481,382, filed May 2, 2011, the disclosure of which is hereby incorporated by reference herein in its entirety.

BACKGROUND

Small scale HVAC systems are typically controlled by "discrete" or "fixed task" controllers. Examples of small scale HVAC systems include cabinet controllers, residential air conditioning systems, and single room controller systems such as computer rooms, archive vaults, clean rooms and laboratories. The discrete controllers used in these systems are characterized as having all control circuits disposed on a single integrated circuit board, and are typically mass produced and of relatively low cost. The discrete controllers can also be of compact design, which finds favor in certain applications such as cabinet controllers. Discrete controllers have also become increasingly sophisticated, with some units designed to accommodate not only temperature inputs, for example, but also humidity control, digital I/O for damper control in zoned heating applications, and/or supply/exhaust air flows.

The various discrete devices described above tend to differ enough from each other so as to require custom build for production. That is, a cabinet controller isn't particularly well suited as laboratory room controller because of the lack of sophistication. Likewise, the laboratory room controller is ill suited as a cabinet controller for lack of compactness and the presence of features which are not utilized, which drives up the cost. From the stand point HVAC equipment supply, it would be desirable to manufacture a system that does not require a custom build for each, i.e., one from which a wide range of devices can be produced from a common platform.

"Modular" controllers can offer the flexibility of configuring controllers for a variety of applications from a single platform. Such modularity finds advantages in large scale operations, such as office buildings and warehouses. However, for the residential market, modular controllers can be more expensive than mass produced discrete controllers. Also, modular control systems are typically less compact than discrete controller systems, which can be a detriment in certain applications.

Another aspect of discrete controllers, at least as used in the residential setting, is the implementation of high gain ("on/off") control. Standard air conditioning units are targeted so that the duty cycle operates about 10 times an hour (i.e., within a 6-minute cycle). That is, for a 25% duty cycle, it is desired that the compressor be on for 12 minutes, off for 4½ minutes; for a 50% duty cycle on for 3 minutes, off for 3 minutes; and so on. The energy required to bring a compressor on line is about the same amount of energy required to run the compressor at steady state for about 5 minutes. Hence, if an air conditioner is cycled the desired 10 times per hour, the amount of energy required for startup of the unit is the same as for operating the unit at steady state for about 50 minutes. Put another way, if an air conditioner is operating at 50% load (i.e., 10 cycles of 3 minutes each in an hour), the amount of energy consumed is the equivalent of 80 minutes of steady state operation.

A controller that offers the compactness of discrete controllers but with the flexibility to enable production of several controller types from a common platform would be welcome. Also, a controller that mitigates the energy-consuming effect of multiple starts and stops in residential HVAC systems would also be a welcome development.

SUMMARY

Various embodiments of the invention provide a discrete core controller for certain core functions while also providing modular capability that provides flexibility for a broad range of applications, all from a common platform. Currently existing systems typically apply either fixed control or modularity in their designs, but not both. The discrete core controller can provide a compact solution in certain control applications, such as cabinet control. Some embodiments can also utilize a variety of power inputs, both AC and DC, for ready adaptation in various environments.

Certain embodiments also include control schemes that reduce the cycling of air conditioner compressors in the residential setting. In one embodiment, the control scheme includes a "learning algorithm," wherein the controller essentially observes the cycling and operating conditions of the air conditioning system under standard high gain control, then determines and controls the compressor to operating speeds that reduces the number of cycles.

In other embodiments, the controller can utilize distributed intelligence in some or all of the modules to enhance performance. This is not common practice in the industry as a usual application typically contains a single processor. The advantage of this topology is that each remote device or task has the ability to function independently to perform complex and time-critical calculations then combine all aspects of the data stream into both local display and remote common communication channel groups. This is in contrast to devices and methods currently practiced in the industry, wherein multiple tasks or devices compete for the limited bandwidth of a single processor and then report locally or into a single data stream.

In one embodiment, a master control unit increases the cycle ON time at a corresponding compressor and fan speed reduction while controlling to indoor temperature map goals and compensating for outdoor temperature and humidity load variations. A proportional-type control loop, residing in the computer-readable memory storage device and executed by a central microprocessor, dynamically reduces the OFF period of the cycle by commanding slaved variable speed drive controller modules to reduce speeds of the compressor and, optionally, the speeds of the condenser and evaporator fans. The OFF period of the cycle is held as close to zero as the load permits.

In one embodiment, a plurality of master control units, each controlling an air conditioning unit, are ganged together to in a rotating the master/slave arrangement control unit that is the designated master attempts to satisfy the thermal load request with its respective air conditioning unit. However, if the designated master is not able to meet the load requirements, then the designated master requests additional capability from an additional slaved master control units or units. The designated master can then cycle the demand of the first of the slaved master control units on and off to meet the additional demand, in addition to operating its own respective air conditioning unit. The additional air conditioning units are thus added one at a time until either all resources are running at 100% capacity, or the thermal demand is satisfied. Moreover, in one embodiment of the invention, the role of designated master is rotated amongst the plurality of master control units. Rotation of the designated master function distributes the wear on the units for extended maintenance/replacement cycles.

DETAILED DESCRIPTION

Figure 1:
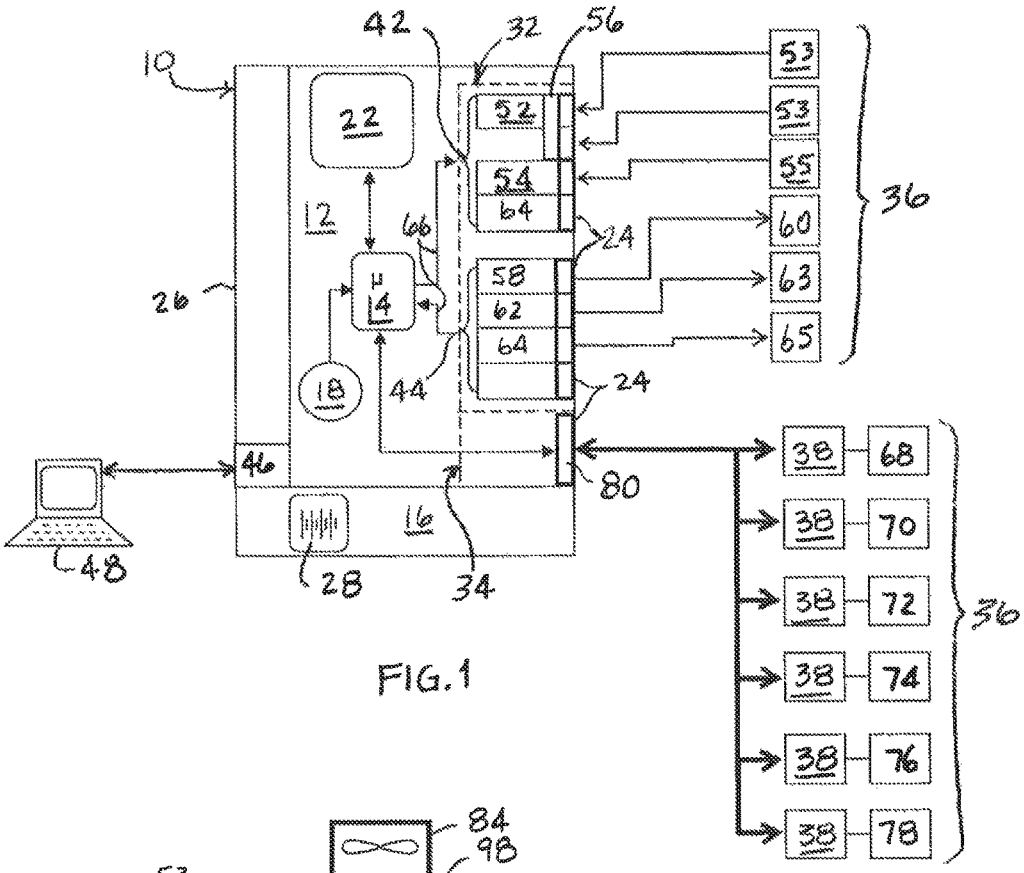
FIG. 1 is a schematic of a base controller and various peripherals in an embodiment of the invention.

Referring to FIG. 1, a base controller 10 is depicted in an embodiment of the invention. The base controller 10 includes a master control unit 12 including a central microprocessor 14 operatively coupled with a power interface/supply 16, a time-of-day clock 18, a computer-readable memory storage device 22, an input/output (I/O) interface 24 and a user interface 26. Various components of the base controller 10 can also be operatively coupled with a backup power source 28, such as a 20-year lithium battery. The master control unit 12 can comprise a "discrete" or "fixed task" control portion 32 and a "modular" or "expandable" control portion 34, both of which can be operatively coupled with a plurality of peripheral devices 36. The central microprocessor 14 communicates with, controls and/or synchronizes the activities of the peripheral devices 36 via the fixed task and modular control portions 32 and 34. The fixed task portion 32 includes a plurality of input circuits 42 and output circuits 44 operatively coupled with the I/O interface 24. The modular control portion 34 communicates with the various peripheral devices 36 via controller modules 38. The various components of the system can be designed to operate from −40° C. to +80° C. and at 5% to 95% relative humidity non-condensing.

The computer readable storage device 22 can include control algorithms for feedback control of certain peripheral devices. The control algorithms can include proportional control, integral control, derivative control, and/or combinations thereof. The computer readable storage device can also include learning algorithms to augment more efficient control of a subject system.

In various embodiments, the user interface 26 includes a key pad and display. Optionally, or in addition to the key pad and display, the user interface 26 can comprise an external communications port 46 for communicating with a computer device 48 such as a personal computer, notebook computer, smartphone or a custom handheld device. One or more external communications ports 46 can be provided, compatible, for example, with universal serial bus (USB), ETHERNET, RS-232/485, inter-integrated circuit ($I^2C$) or a wireless communications link. Software protocols for the external communications can include FLEXBUS, MODBUS, LONWARE, or other software protocols available to the artisan.

In one embodiment, the input circuits of the fixed task control portion 32 include a temperature measurement circuit 52 for operative coupling with one or more temperature sensors 53 and a digital tachometer measurement circuit 54 for operative coupling with a digital tachometer 55. A multiplexer 56 can be operatively coupled with the temperature measurement 52, enabling the sequential measurement of a plurality of the temperature sensors 53. The output circuits can include one or more pulse width modulated (PWM) output circuits 58 to control, for example, air moving devices 60, and relay driver outputs 62 to control, for example, heating devices 63. A plurality of general purpose digital I/O circuits 64 can also be included in the fixed task control portion 32 to sense binary inputs such as relay closures and for binary output such as alarm outputs 65.

The input and output circuits 42 and 44 of the fixed task controller 32 are "hardwired" to the central microprocessor 14. That is, in contrast to the communication between the central microprocessor 14 and the controller modules 38, the communication between the central microprocessor 14 and the input and output circuits 42 and 44 is implemented over direct and permanent electronic circuits 66 and without any intermediary microprocessor or intelligence. In one embodiment, the central microprocessor 14 and the input and output circuits 42 and 44 are disposed on a single integrated circuit board.

The modular control portion 34 of the master control unit 12 includes a module communications interface 80 operatively coupled with the central microprocessor 14 for communication with the one or more controller modules 38. The module communications interface 80 can be operatively coupled with an expansion chassis (not depicted) for housing the controller modules 38. The controller modules 38 are available for control of a wide variety of devices, including but not limited to variable frequency drives 68, resistive power controls 70, thyristors 72, relays 74, sensor modules 76 (e.g., temperature, temperature/humidity, pressure, voltage, current, speed/velocity) as well as custom designed modules 78.

Functionally, the controller modules 38 can possess local intelligence, such as a programmed microprocessor, to perform certain tasks. The controller modules 38 can be slaved to perform these tasks as directed or initiated by the central microprocessor 14. In one embodiment, each controller module 38 can be designed to facilitate the control/energy reduction of a single type of device (compressor, heater, fan, humidifier) or sensor (temperature, humidity, enthalpy, voltage, current, frequency, RPM). Generally, multiple controller modules 38 of any combination can be mapped into the base controller 10 and slaved to the central microprocessor 14. Furthermore, multiple master control units 12 can be combined together into a gang control block in a lead/lag configuration, all common, or custom control configurations, such as described in Example 3 below. Certain embodiments disclosed herein can be designed into new devices or implemented as a retro-fit into existing installations. Specific and non-limiting examples of configurations are provided below.

Example 1

Figure 2:
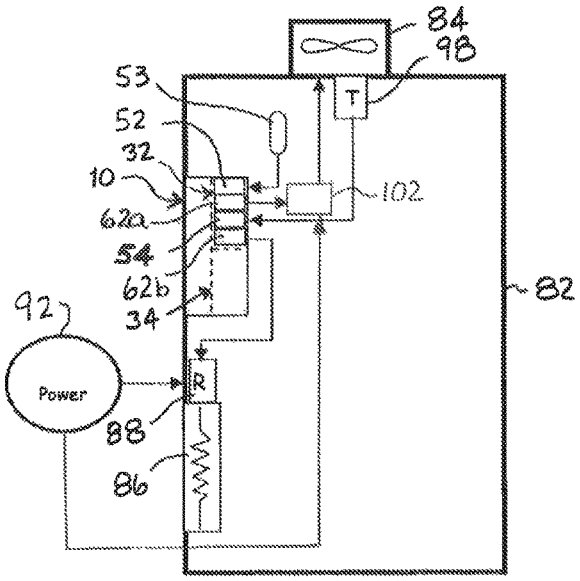
FIG. 2 is a schematic of the base controller of FIG. 1 in use as a cabinet controller in an embodiment of the invention.

Referring to FIG. 2, the base controller 10 serves as a "cabinet controller" to industrial fan trays, heat exchangers, air conditioner and electrical heater systems. These devices are so-named because they embody a thermal control system to an enclosure such as a cabinet 82 for the purpose of maintaining the internal temperature of the cabinet 82 within a specified range. As such, the fixed task portion 32 of the master control unit 12 is configured to control the output circuit 58 for velocity control of an air moving device 84 and to control the relay driver output 62 for control of a heating device 86 via a relay 88 that is sourced by an AC or DC power source 92. The temperature measurement circuit 52 is tailored for the measurement of temperature sensors covering typical cabinet operating temperature ranges, for example, from −40° C. to 100° C.

In one embodiment, the master control unit 12 is utilized as a stand-alone control unit that implements proportional-integral control and requires no modules for basic operation. The master control unit can utilize the following internal resources to accomplish fixed tasks:

- discrete sensor inputs for temperature control and monitoring.
- discrete PWM control outputs for velocity control of air moving devices.
- digital tachometer inputs & digital I/O for closed loop control of the air moving devices
- discrete relay driver output for control of an electrical heating or voltage-controlled oscillator device.
- discrete alarm outputs for optically isolated alarm notifications (e.g., 80 v, 20 ma rated, galvanically isolated)
- display and operator keypad inputs for user interaction.

The master control unit 12 can be powered from a 24-volt AC or DC supply.

Cabinet controllers are primarily temperature-controlling devices. One or more sensors 53 can be combined in one of the following control scenarios; single sensor, dual/redundant, simple average, or hottest point. A plurality of fans, impellers, and/or other air moving devices 84 can be controlled by coupling the discrete PWM output circuit 58 of the master control unit 12 to the corresponding control input of the air moving device 84. In one embodiment, the discrete PWM output circuit 58 outputs an open collector signal with a selectable weak pull-up to 12V operating in the 1-4 KHz range with 5-50% or 5-95% duty-cycle control. The air moving device 84 can include a tachometer 98, the output of which can be coupled to the input of the digital tachometer measurement circuit 54 of the master control unit 12 for closed loop operation. The signal of the tachometer 98 can operate on an open collector or as a 3-12V square wave signal of, for example, 1-12 pulses/rev.

The closed loop control of the air moving device 84 can be configured to mathematically perform an automatic servo elimination of velocity variations due to input voltage flocculation and/or dynamic load characteristics. Optionally, open loop control can also be implemented.

The speed of the air moving device 84 can be individually controlled and directly correlated with measured control temperature using the following control points: low OFF, low dwell, medium control, and high control. Alternatively, the computer-readable memory storage device 22 (FIG. 1) can be configured to facilitate the control of to air moving device 84 to any control curve.

Power from the power source 92 for the air moving device 84 can be routed around the master control unit 12. The discrete relay driver 62*a* outputs a PWM to drive a solid state relay 102, thereby modulating the voltage supplied to the air moving device 84 for velocity control. In other embodiments, power can be routed through and modulated within the master control unit 12, for example when a voltage controlled air moving device is implemented.

An electrical heating device 104 can be activated from the output of a discrete relay driver 62*b* via a solid state relay 106. The master control unit 12 can be configured to deliver, for example, ON/OFF or PWM control to the electrical heating device 104 for elevating the temperature of the enclosure. High gain (ON/OFF) control can incorporate a simple hysteresis value to separate ON from OFF for lengthening the cycles in the control loop.

When preset alarm conditions are exceeded (e.g., temperature), the open collector outputs can be enabled. Isolation of the alarm outputs enable electrical indications to be coupled to an outside system. Alarm conditions can be configured to automatically clear when the condition causing the alarm is removed.

The system can also be programmed to display certain parameters on the user interface 26, such as the internal enclosure temperature, any active alarms, menus allowing the user to configure the system, and the present running status of the master control unit 12. These parameters can be supplied to the dedicated display, and/or transmitted to a remote device such as a central computer system or to a local computer system for display via the external communications port 46.

Where a local keypad input is utilized with the operator interface, operator buttons can enable navigation for control system configuration (e.g. an up button ('^') and a down button ('v') for menu selection and increase/decrease command, a program button ('P') for entering programming mode, and a select button ('S') for setting selection).

Example 2

Figure 3:
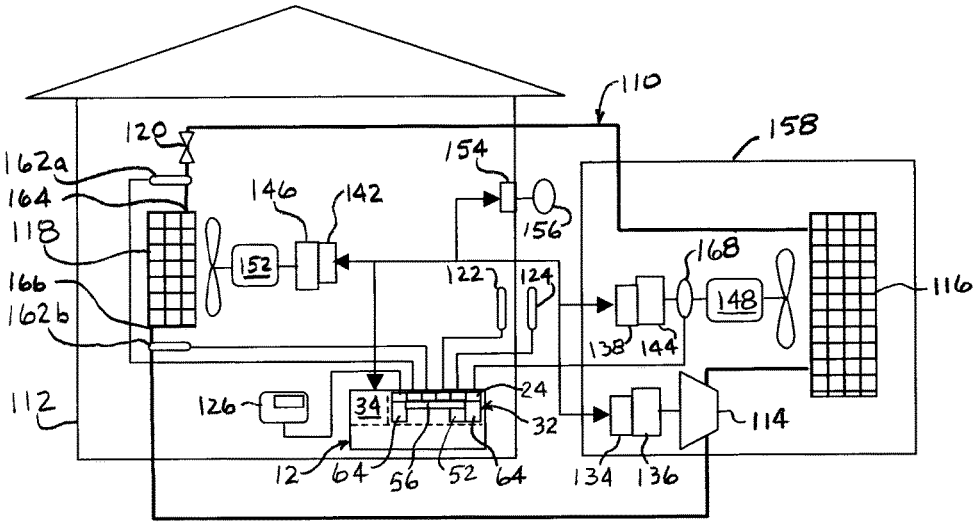
FIG. 3 is schematic of a residential air conditioning system being controlled by the base controller of FIG. 1 in an embodiment of the invention.

Referring to FIG. 3, the base controller 10 is depicted as controlling a residential air conditioning system 110 for a residence 112 in an embodiment of the invention. The residential air conditioning system 110 comprises a compressor 114, a condenser 116, an evaporator 118 and an expansion device 120. In this embodiment, both the fixed task capabilities and the modular capabilities of the of the master control unit 12 are combined in a hybrid control scheme.

In one embodiment, the temperature measurement circuit 52 of the fixed task portion 32 is operatively coupled with an indoor temperature sensor 122 and an outdoor temperature sensor 124. A residential thermostat 126, which controls activation of the air conditioning system 110, can, in some instances, provide a digital input to one of the digital I/O circuits 64. The computer-readable memory storage device 22 of the master control unit 12 can be configured with proportional-type control loop instructions (e.g., proportional-integral or proportional-integral-derivative) for execution by the central microprocessor 14.

In one embodiment, the indoor temperature sensor 122 is mounted proximate an air intake vent such that the temperature sensor 122 is in the flow stream of the air going into the air intake. The movement of air over the temperature sensor provides convective coupling that enhances the responsiveness of the indoor temperature sensor 122.

In the depicted embodiment, the modular control portion 34 of the master control unit 12 is coupled with the following modules: a variable frequency drive control module 134 that controls a variable frequency drive 136 for speed control of the air conditioner compressor 114; bidirectional triode thyristor (TRIAC) phase control modules 138 and 142, each controlling a TRIAC 144 and 146 for controlling the speed of the condenser fan 148 and the evaporator fan 152; and a humidity module 154 (or modules) operatively coupled to a humidity sensor 156 (or sensors) to measure the outdoor humidity and optionally the indoor humidity. Optionally, speed control of the condenser and evaporator fans 148 and 152 can be performed using variable frequency drive and variable frequency drive controllers in place the TRIACs 144, 146 and TRIAC phase control modules 138, 142. Another alternative to TRIACS are metal-oxide-semiconductor field-effect transistors. The various controller modules can be distributed remotely from the master control unit 12 (as depicted), for example, indoors near the evaporator 118, and outdoors within a cabinet 158 containing the condenser 116.

In one embodiment, an inlet temperature sensor 162*a* and an outlet temperature sensor 162*b* are arranged to measure the refrigerant temperatures proximate the inlet 164 and outlet 166, respectively, of the evaporator 118. The inlet and outlet temperature sensors 162*a* and 162*b* can be operatively coupled to the temperature measurement circuit 52 of the fixed task portion 32 via the multiplexer 56.

The master control unit 12 can be powered from a low voltage 24 VAC transformer (not depicted). In one embodiment, the master control unit 12 is activated via one of the discrete digital I/O circuits 64 coupled to the residential system thermostat 126 for ON/OFF cooling requests. In other embodiments, the master control unit 12 can sense ON/OFF cooling requests without input from the residential thermostat 126 by sensing when the compressor 114 is activated. Such sensing can be accomplished, for example, using a current sensing device with a hall effect sensor 168 to provide a digital input to one of the discrete digital I/O circuits 64 whenever the compressor 114 draws current.

Figure 4:
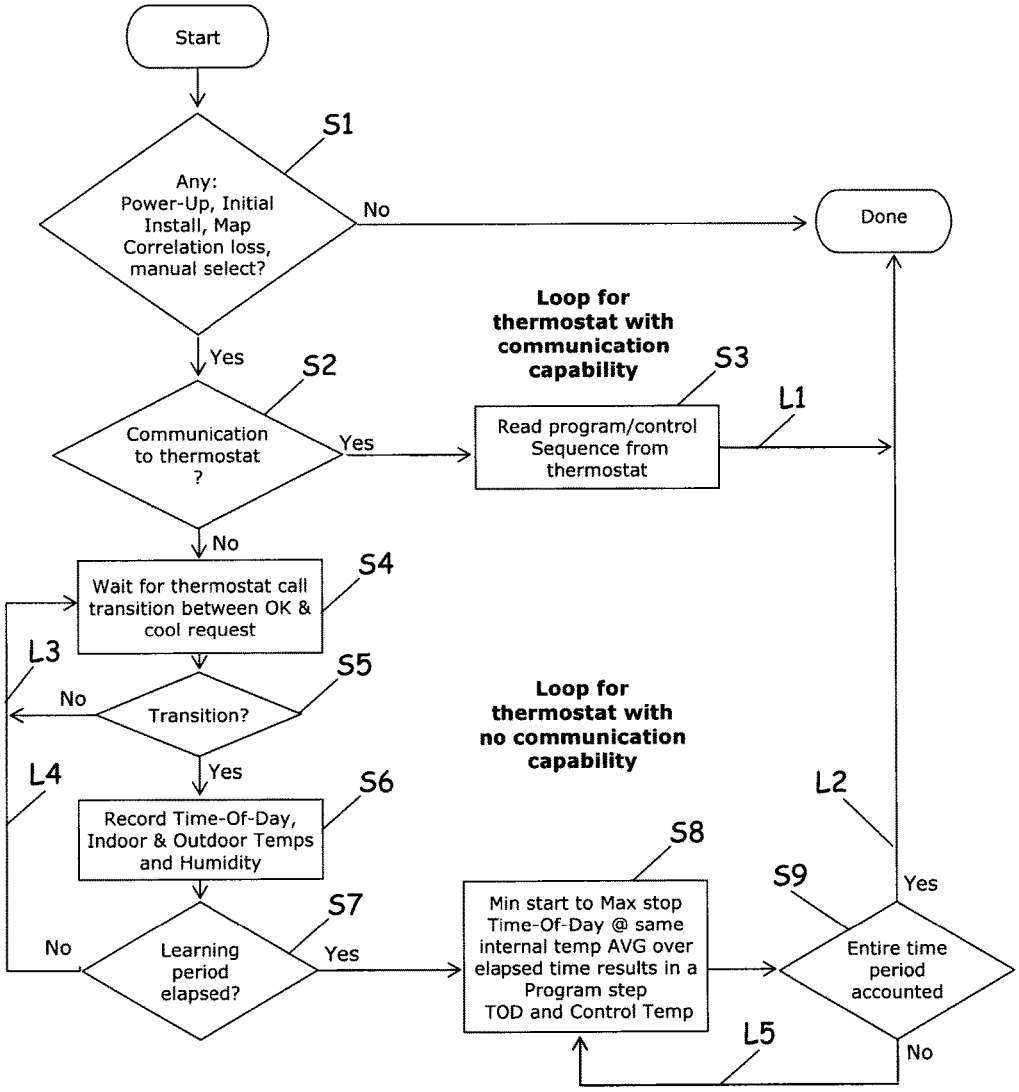
FIG. 4 is a flow chart for establishing a learning algorithm in an embodiment of the invention.

Referring to FIG. 4, a flow chart 170 for establishing a learning algorithm for the master control unit 12 is presented for embodiments of the invention. In one embodiment, the thermostat 126 informs the master control unit 12 of the set point temperature. Conveyance of the set point information can be accomplished by sending an analog signal to a controller module 38 (not depicted in FIG. 3) that performs an analog-to-digital conversion for use by the central microprocessor 14, or by sending a digital signal over a communications link to the communications interface 80 (also not depicted in FIG. 3). In this way, the master control unit 12 knows, or can readily learn, at what temperature the thermostat 126 will deactivate the air conditioning system 110. In still other embodiments, the entire program/control sequence of the thermostat 126 can be downloaded to the master control unit 12. The process for obtaining such information directly from the thermostat 126 is depicted in loop L1 of FIG. 4.

However, certain embodiments of the invention are tailored to accommodate thermostats that lack such sophisticated communication capabilities by undertaking a more extensive mapping process, depicted generally in loop L2 of FIG. 4. In one embodiment, the master control unit 12 synchronizes itself to the existing thermostat programming by monitoring the ON/OFF cycle times (steps S4, S5 and loop L3), indoor and outdoor temperatures and outdoor humidity (step S6) for a period of time (step S7 and loop L4) in order to map the existing thermostat programming (steps S8, S9 and loop L5). Non-limiting examples of the period of time for this mapping is 24 or 48 hours.

During the mapping process, temperature readings from the indoor and outdoor temperature sensors 122 and 124 are gathered using the fixed task portion 32 of the master control unit 12. Humidity readings can be gathered from the humidity sensor 154 via the humidity module 156. The ON/OFF durations can also be correlated to the time of day using the time-of-day clock 18 (FIG. 1) of the master control unit 12. Mapping can be initiated by any of a number of events, including initial installs, map cycle correlation loss and manual selection.

When the time period for mapping is completed, the proportional-integral control loop can be implemented to begin reducing the speeds of the compressor 114 and the speeds of the condenser and evaporator fans 148 and 152 via the variable speed drive controller modules 134, 138 and 142, respectively, when the compressor is cycled on.

Figure 5A:
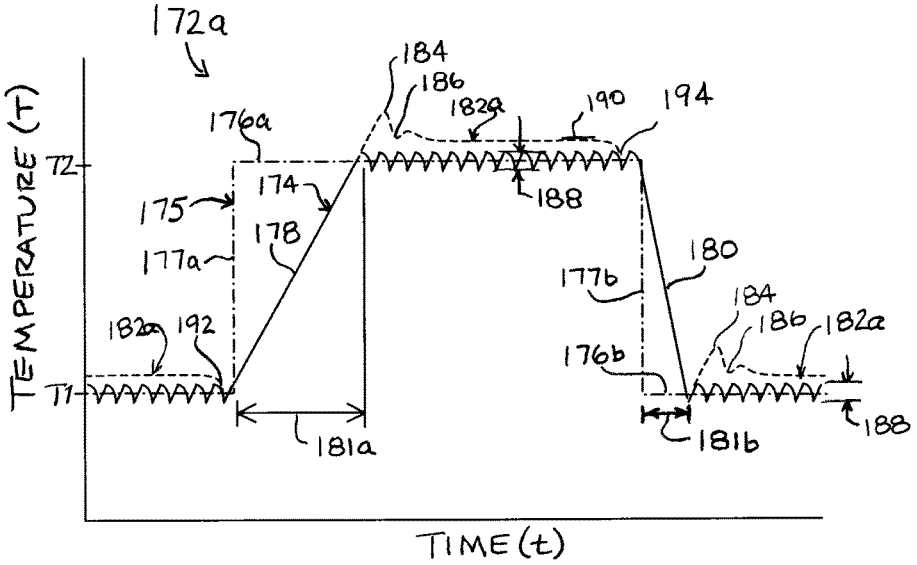
FIGS. 5A and 5B are graphs of a time-temperature map and desired temperature control profiles attendant thereto in embodiments of the invention.

Referring to FIG. 5A, a resultant time-temperature map 172*a* obtained from the execution of steps S8, S9 and loop L5 is and a method of controlling thereto is described in greater detail in an embodiment of the invention. The time-temperature map 172*a* presents the time vs. indoor temperature data 174 acquired with the temperature sensor 122 over a 24-hour period for a simple dual temperature program having a first nominal temperature T1 and a second nominal temperature T2.

The temperature data 174 may portray a characteristic "saw-tooth" profile about the respective nominal temperatures T1 and T2—an artifact of the ON/OFF cycling of the thermostat 126. Each "saw tooth" represents a cycle period at a given set point temperature. The peak-to-valley temperature swing of the saw tooth temperature profile is effectively the dead band 188 of the controlling thermostat 126.

The time vs. indoor temperature data 174 is driven by a target or desired set point schedule 175 (depicted in phantom) that is programmed into the thermostat 126. The set point schedule 175 is depicted as having plateau regions 176*a* and 176*b* (referred to collectively or generically as plateau regions 176) during which time the temperature of the set point schedule 175 is constant. The set point schedule 175 is further characterized as having a step up transition 177*a* and a step down transition 177*b* (referred to collectively or generically as step transitions 177) between the plateau regions 176. The step transitions are essentially the point in time where a change in the programmed set point temperature occurs.

The time vs. indoor temperature data 174 is characterized by an increasing temperature ramp 178 and a decreasing temperature ramp 180, each transitioning between the nominal temperatures T1 and T2. The increasing temperature ramp 178 represents the upward drifting of the temperature when the air conditioning system 110 is deactivated. The decreasing temperature ramp 180 represents the downward driven temperature when the air conditioning system 110 is operating at 100% capacity to achieve the lower nominal temperature T1.

In certain embodiments, the master control unit 12 does not know the set point schedule 175 a priori, but can infer the nominal values T1 and T2 with sufficient accuracy from the repeated cycles of the time vs. indoor temperature data 174. The timing of the step transitions 177 can also be estimated with sufficient accuracy. It is known, for example, that the step up transition 177*a* is within a cycle of the beginning of the increasing temperature ramp 178, and that the step down transition 177*b* is within a normal cycle period of the beginning of the decreasing temperature ramp 180. Such resolution is sufficient for purposes of programmed residential temperature control. The master control unit 12 can be programmed to identify the step up transition 177*a* as proximate the beginning of the increasing temperature ramp 178, and to establish the new set point temperature T2 thereafter. Similarly, the master control unit 12 can be programmed to identify the step down transition 177*b* as proximate the beginning of the decreasing temperature ramp 180.

Coincident with the increasing temperature ramp 178 is a de-energization period 181*a* where the compressor 114 is not energized, during which time the indoor temperature of the residence 112 drifts upward to T2. The de-energization period 181*a* generally varies. That is, the higher the outdoor temperature, the shorter the time required (de-energization period 181*a*) for the indoor temperature of the residence 112 to attain the temperature that causes the thermostat 126 to activate the air conditioning system 110. Accordingly, in one embodiment, upon reaching the end time period immediately prior to a step up transition (e.g., step up transition 177*a* at the end of the plateau region 176*a*), the thermostat 126 will autonomously de-energize the air conditioning system 110. The master control unit 12 is effectively disabled until the thermostat 126 re-energizes the air conditioning system 110.

Coincident with the decreasing temperature ramp 180 is maximum cooling period 181*b*, during which time the indoor temperature of the residence 112 is lowered to temperature T1. The maximum cooling period 181*b* can vary. That is, the higher the outdoor temperature, typically the longer the time to achieve the cooler set point. The master control unit 12 can be programmed to operate the compressor 114 at 100% capacity until the thermostat 126 de-energizes the air conditioning system 110. The master control unit 12 can be programmed to control to the temperature T1 after the de-energization at the end of the decreasing temperature ramp 180.

A controlled temperature profile 182*a* expected from the air conditioning system 110 under control of the master control unit 12 after completion of the mapping process is presented in dashed lines on FIG. 5A. In one embodiment, a proportional-type control loop is provided in the computer-readable memory storage device 22 and executed by the central microprocessor 14. In the parlance of proportional-type control, the indoor temperature is the process variable and the speed of the compressor 114 is the manipulated variable. The indoor temperature is thus controlled to a set point by manipulating or controlling the speed of the compressor 114.

Accordingly, the controlled temperature profile 182*a* can include overshoots 184 and undershoots 186 after each transition ramp 178 and 180, characteristic of proportional-type control. The programmed control loop characteristics can be stored in non-volatile memory for reuse during the next correlating cycle period to enhance energy savings and to prevent data loss due to a power cycle.

In one embodiment, the condenser fan 148 is controlled to a speed that is in proportion with (though not necessarily in direct proportion with) the speed of the compressor. That is, if speed of the compressor 114 is increased, the speed of the condenser fan 148 is also increased, but not necessarily by the same fraction or amount.

The proportional tracking of the speed of the condenser fan 148 can be controlled in a separate closed loop control algorithm. The purpose of having the speed of the condenser fan 148 in proportion to speed of the compressor 114 is to make sure the removal of heat from the condenser 116 is in sufficient proportion with the capacity produced by the compressor 114. The removal of heat can be directly monitored by measuring the temperature difference between the inlet and outlet temperature sensors 162*a* and 162*b* of the evaporator 118. This temperature difference is indicative of the pressure of the refrigerant, which should be maintained within tolerances specified by the refrigerant manufacturer. Thus, the central microprocessor 14 can be programmed with a proportional-type control algorithm that controls the speed of the condenser fan 148 so that the difference between the measured inlet and outlet temperature sensors 162*a* and 162*b* is maintained in accordance with manufacturer specifications for the pressure of the refrigerant.

In another embodiment, the evaporator fan 152 is also controlled in proportion to the speed of the compressor 114. The speed of the evaporator fan 152 (e.g., the "furnace blower" in many residential systems) is what controls the temperature level of the inlet and outlet temperature sensors 162*a* and 162*b* of the evaporator 118. These temperature levels should also be controlled to keep the air conditioning system 110 in balance. The central microprocessor 14 can implement a proportional-type control algorithm that controls the speed of the evaporator fan 152 so that the temperature levels of the inlet and outlet temperature sensors 162*a* and 162*b* are maintained at a desired level.

Functionally, the objective is to run the compressor 114 and, optionally, the condenser and evaporator fans 148 and 152 at the minimum possible speed (within manufacturer limits for non-damaging operation) to approach a single cycle per programmed step period in the existing thermostat cycle. Attention must also be directed to maintaining the indoor temperature close to, but slightly above, the dead band 188 of the thermostat 126 so as not to cause the thermostat 126 to deactivate the air conditioning system 110. In one non-limiting example, the target temperature is between one and three degrees Fahrenheit above the dead band 188 of the thermostat 126.

Accordingly, the control algorithm residing in the computer-readable storage device 22 should be tailored to limit the undershoots 186 so as not to dip into the dead band temperature ranges 188 about the nominal temperatures T1 and T2. To that end, the outdoor temperature and outdoor humidity gathered during the mapping process can also be utilized in estimating the steady state operating capacity of the air conditioning system 110 at a given temperature difference between the indoor and the outdoor temperature, as well as at a given outdoor humidity. Initial control can be calculated by the duty cycle ratio of the ON duty cycle vs. the OFF duty cycle and the difference between the indoor and the outdoor temperature/humidity data collected during the mapping process. The required cooling capacity of the system can be estimated by multiplying the duty cycle ratio by the temperature/humidity difference.

Figure 5B:
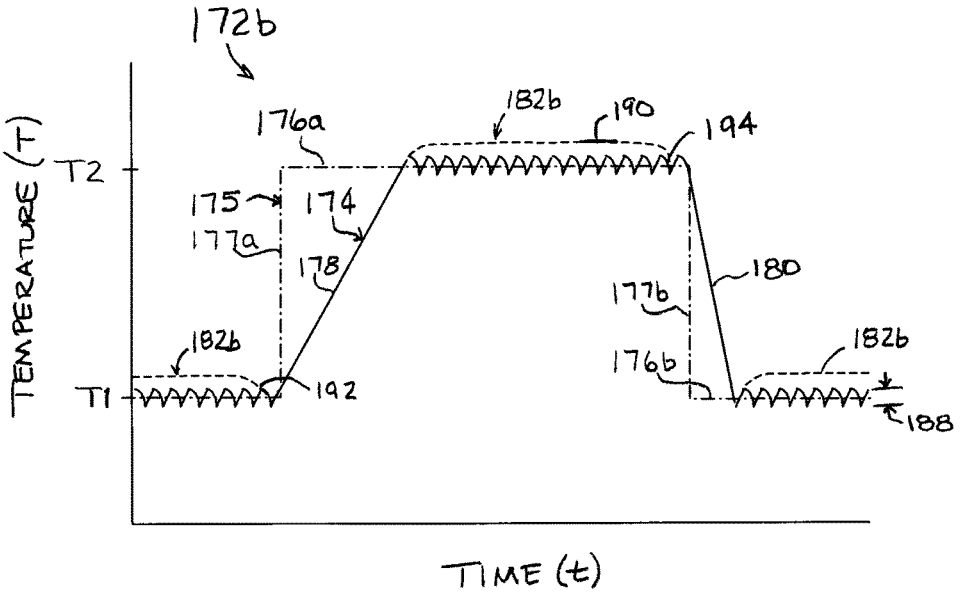

Referring to FIG. 5B, a time-temperature map 172*b* having a controlled temperature profile 182*b* that is critically dampened is depicted in an embodiment of the invention. In one embodiment, both the indoor and the outdoor temperature sensors 122 and 124, and optionally the humidity sensor 156, can be monitored on an ongoing basis, i.e., during as well as after the mapping sequence. Note from FIG. 5A that, after the initial adjustments characterized by the overshoot 184 and undershoot 186, the controlled temperature profile 182*a* settles to a quasi-steady-state mode that is at or close to a target temperature 190. The speed of the compressor 114 in the quasi-steady-state mode can also be constant or within a narrow range of speeds. The speed of the compressor 114 can be monitored by, for example, a tachometer that is part of the variable speed drive control module 144 and the information passed on to the master control unit 12 for recordation.

The speed information gathered can be used to dynamically compensate for variable load characteristics and to provide the parameters for operating the air conditioning system 110 in a "critically dampened" mode. For example, a trend may be observable between the speed of the compressor 114 and the difference between the indoor and outdoor temperatures at quasi-steady-state. The central microprocessor 14 can be programmed to use these trends to correlate these trends and predict the quasi-steady-state speed of the compressor 114 for a given controlled temperature and the difference between that set point and the outdoor temperature. Such information is useful in establishing a critically dampened control response. Even where critical dampening is not achieved or necessarily desired, the correlations developed from the trend information can be useful in minimizing the undershoots 186 of the controlled temperature profile 182*a*. The effects of other information that is gathered, such as the outdoor humidity, indoor humidity and the time of day, can also be utilized to improve the predictive correlation.

In one embodiment, the control algorithm is tailored to operate the air conditioning system 110 at 100% capacity as the end of a normal cycle temperature plateau approaches. This causes the temperature to dip into a dead band temperature range 188 that brackets the nominal temperatures T1 and T2, as depicted at numerical references 192 and 194 of FIGS. 5A and 5B. In one non-limiting example, the master control unit 12 begins the maximum cool down approximately 15 minutes prior to the normal end of the cycle.

The purpose of bringing the temperature into the dead band(s) 188 is to confirm that the program was satisfied and was not changed after the mapping period. If the temperature is either prematurely satisfied or not satisfied at the end of the cycle, then the master control unit 12 assumes that the programming of the thermostat 126 was changed, and a new mapping process is initiated. Also, operation of the compressor and fans at 100% speed for a selectable period of time to scavenge any oil pooling in the system and return it to the compressor.

Alternatively, or in addition, instead of performing the 100% capacity operation at the end of each temperature plateau, the master control unit 12 can be programmed to perform this operation at arbitrary times. Also, master control unit 12 can be manually cycled to restart the mapping process.

The variable speed drive controller modules 134, 138 and 142 can be powered by 3.3 VDC from the master control unit 12. Communications over the module communications interface 80 to the master control unit 12 can be via any one of the communications interfaces enumerated above. Each module is assigned a unique address for communication with the master control unit 12. In one embodiment, the power input converts single or 2 phase AC power to DC with a 400 V limit.

In one embodiment, the variable speed drive control module incorporates a galvanically isolated sinusoidal PWM (SPWM) control via insulated gate bipolar transistors to create a voltage/frequency (V/Hz) operating constant that is provided to the respective output device. The variable speed drive can be connected to both the start and the run windings of the compressor or just the run windings where applicable. The V/Hz constant is adjustable from the standards of 240 v/50 Hz=4.80 to 120 v/60 Hz=2.00, and is stored in non-volatile memory. Control commands from the master control unit 12 can include On, Off, Status, SetSpeed, GetSpeed, SetConfigure, GetConfigure, and Reset.

The phase control modules 138 and 142 can be powered by 3.3 VDC from the master control unit 12. In one embodiment, the power input can switch a single phase AC load with a delay-ON at both positive and negative zero crossings via a galvanically isolated thyristor, such as a TRIAC/Alternistor. The delay can be limited between 1 and 85 degrees of phase. Control commands from the MCU can include: On, Off, Status, SetSpeed, GetSpeed, SetConfigure, GetConfigure, and Reset.

The base controller 10 can be provided as part of a kit to upgrade new or retrofit existing residential air conditioner systems. The method includes providing a kit with a master control unit comprising a central microprocessor operatively coupled with a fixed task control portion and a modular control portion, the fixed task control portion including a plurality of input circuits and a plurality of output circuits. The plurality of input circuits can include a temperature measurement circuit. Also, the central microprocessor is permanently and directly wired to the plurality of the input circuits and to the plurality of the output circuits. The kit includes a plurality of modules including a first variable speed drive control module, a second variable speed drive control module, a first variable speed drive, a second variable speed drive, a first temperature sensor and a second temperature sensor. Also, the kit includes instructions on a tangible medium. These instructions can comprise all or a portion of the following:

- operatively coupling the first variable speed drive control module and the first variable speed drive with a compressor of a residential air conditioner for speed control of the compressor
- operatively coupling the second variable speed drive control module and the second variable speed drive with at least one of a condenser fan and an evaporator fan for control of at least one of the condenser fan and the evaporator fan
- operatively coupling the first variable speed drive control module with modular control portion of the master control unit
- operatively coupling the second variable speed drive control module with modular control portion of the master control unit
- arranging the first temperature sensor to measure an indoor temperature
- arranging the second temperature sensor to measure an outdoor temperature
- operatively coupling the first temperature sensor and the second temperature sensor to the temperature measurement circuit of the fixed task control portion of the master control unit
- operatively coupling the first variable speed drive with the first variable speed drive control module for speed control of the compressor
- operatively coupling the second variable speed drive with the second variable speed drive control module for control of at least one of the condenser fan and the evaporator fan
- arranging the humidity sensor to measure an outdoor humidity
- operatively coupling the humidity sensor and the humidity sensor module to the modular portion of the master control unit.

In one embodiment, the instruction of arranging the first temperature sensor to measure the indoor temperature further instructs mounting the first temperature sensor proximate an air intake.

Example 3

In another embodiment, multiple devices configured as in EXAMPLE 1 or EXAMPLE 2 can be configured as master/ slave combinations in a shared control arrangement. Applications include control of enclosed spaces that experience large temperature swings, such as cell tower equipment shelters.

Figure 6:
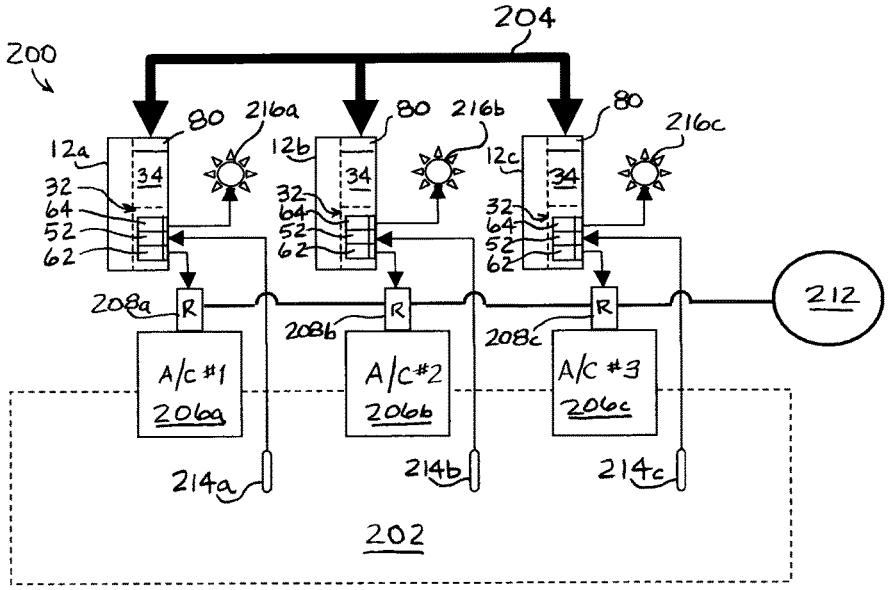
FIG. 6 is a schematic of ganged air conditioning systems in a master/slave arrangement in an embodiment of the invention.

Referring to FIG. 6, a cooling system 200 having rotating master/slave arrangement is depicted for controlling an enclosed space 202 in an embodiment of the invention. Multiple master control units 12*a*, 12*b* and 12*c* are coupled to each other over the module communications interface 80 of the modular control portion 34 via a communication network 204, such as $I^2C$, RS-485, serial-peripheral interface (SPI) bus, wireless, or by other network communications structure. Each master control unit 12*a*, 12*b* and 12*c* is configured with a unique address, and responds only to inquiries made to that address. Each type of unit contains a base address that is unique to the type of unit. Each module also has its serial number loaded into the local memory. The base address and the serial number are added together to create a number that both identifies the type of unit, as well as the unique address of the module being used.

In the depicted embodiment, each master control unit 12*a*, 12*b* and 12*c* (referred to generically as master control unit 12) is operatively coupled with a respective air conditioner unit 206*a*, 206*b* and 206*c* via a respective relay 208*a*, 208*b* and 208*c* (referred to collectively as relays 208). The relays 208 are connected to a power source 212 for selective powering of the air conditioning units 206*a*, 206*b* and 206*c* (referred to generically as air conditioner unit 206). Each relay 208*a*, 208*b* and 208*c* is coupled to the discrete relay driver 62 of the fixed task control portion 32 of the respective master control unit 12*a*, 12*b* or 12*c*.

In one embodiment, respective temperature sensors 214*a*, 214*b* and 214*c* (referred to generically as temperature sensor 214) are coupled to the temperature measurement circuit 52 of the respective master control unit 12. Also, each master control unit 12*a*, 12*b* and 12*c* is operatively coupled with a respective alarm 216*a*, 216*b* and 216*c* (referred to generically as temperature sensor 216) via one of the discrete digital I/O circuits 64 of the respective fixed task portion 32*a*, 32*b* and 32*c*. Alternatively, a single temperature sensor (not depicted) and/or a single alarm (not depicted) can be operatively coupled with all of the master control units 12*a*, 12*b* and 12*c*, which may require implementation of proper electrical isolation between the master control units 12. Optionally, the single temperature sensor and/or single alarm can communicate with the master control units 12*a*, 12*b* and 12*c* over the communications network 204.

In one embodiment, each master control unit 12*a*, 12*b* and 12*c* is software configured to operate in two different modes: a "designated master" mode and a "slave" mode. In the "designated master" mode, the respective master control unit 12 is the master of itself and of the other master control units 12. When operating as the designated master, the master control unit 12 is configured to operate as a closed loop controller, utilizing the respective temperature sensor 214*a*, 214*b* or 214*c* as the feedback element. Second, each master control unit 12 is configured to operate in a "slave" mode, wherein the unit 12 does not operate as a closed loop controller, but instead activates and deactivates the respective air conditioning unit 206 at the command of the designated master.

Figure 7:
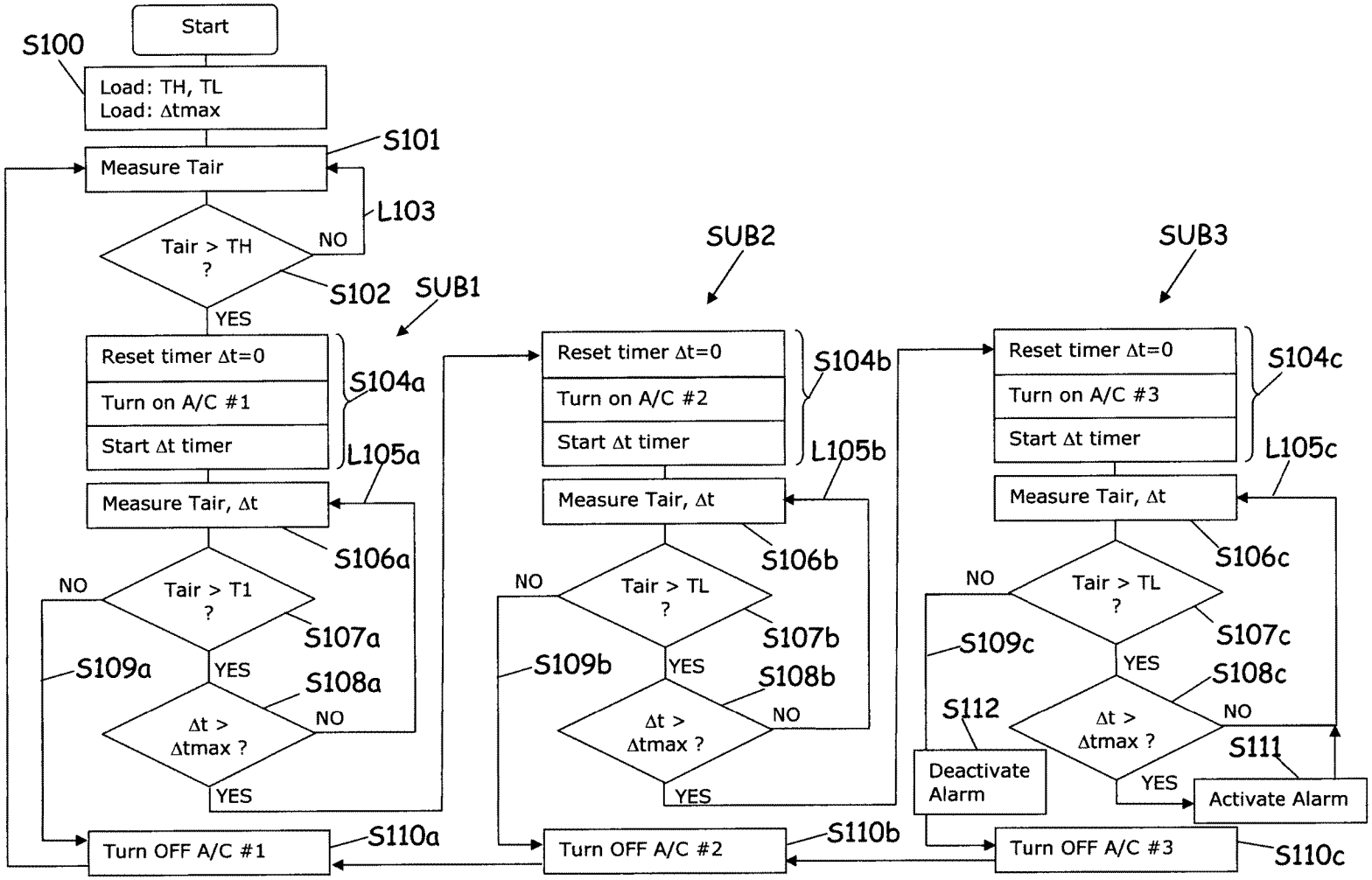
FIG. 7 is a flow chart of a control algorithm for use by the ganged air conditioning systems of FIG. 6 in an embodiment of the invention.

Referring to FIG. 7, a flow chart 220 depicting the software configuration for the designated master mode is presented in an embodiment of the invention for control of the rotating master/slave arrangement 200. In this embodiment, a high temperature TH, a low or target temperature TL, and a maximum time interval Δtmax are accessed by the microprocessor 14 (step S100). In this embodiment, TH represents the high temperature limit which initiates activation of the cooling system 200 and TL represents the low temperature limit at which the cooling system 200 is deactivated. That is, the difference TH−TL is the deadband of the cooling system 200. The maximum time interval Δtmax represents a maximum time that is allotted for achieving the objective temperature.

The air temperature Tair within the enclosed space 202 is measured using the respective temperature sensor 214 that is coupled with the master control unit 12 of the designated master (step S101). If the air temperature Tair is not greater than TH (step S102), the system remains in a monitoring loop (loop L103) of the air temperature Tair. If the air temperature Tair is greater than TH, the designated master then enters a first control subroutine (SUB1). The first control subroutine initiates activation of "A/C #1" (step S104*a*) which is the air conditioning unit 206 coupled with the fixed task portion 32 of the respective master control unit 12 of the designated master. The initiation step S104*a* includes resetting a timer counter Δt to zero, activating A/C #1, and starting the timer counter.

Upon activation of the A/C #1, the system goes into a timed loop (loop L105*a*), wherein the designated master measures the air temperature Tair and the elapsed time Δt (step S106*a*). If the air temperature Tair drops below the target temperature TL (step S107*a*) before Δt exceeds Δtmax (step S108*a*), the timed loop L105*a* is exited (step S109*a*), A/C #1 is deactivated (step S110*a*), and the algorithm returns to the air monitoring loop (loop L103). However, if A/C #1 does not acquire the target temperature TL before Δt exceeds Δtmax, the timed loop 105*a* is exited to enter a second control subroutine (SUB2).

The second control subroutine SUB2 comprises many of the same aspects as the first control subroutine SUB1, and the steps are similarly identified as steps S104*b* through S110*b*. Differences between the SUB2 and the SUB1 control subroutines are found at steps S104*b* and S110*b*, where A/C #2 is activated or deactivated instead of A/C #1. Activation of A/C #2 is controlled by the designated master by sending a command over the communication network 204, addressed to the slaved master control unit 12 of the respective air conditioning unit 206 that constitutes A/C #2. Control subroutine SUB2 is executed until one of two conditions are met: (1) the target temperature TL is achieved, in which case A/C #2 and AC #1 are deactivated (steps S110*b* and S110*a*) and control is returned to the monitoring loop (loop L103); or (2) the target temperature TL is not achieved within the allotted maximum time interval Δtmax, in which case the timed loop L105*b* is exited to enter a third control subroutine (SUB3).

Likewise, the third control subroutine SUB2 comprises many of the same aspects as the control subroutines SUB1 and SUB2, with the exception that A/C #3 is activated and deactivated at steps S104*c* and S110*c*, respectively. Activation of A/C #3 is controlled by the designated master by sending a command over the communication network 204, addressed to the slaved master control unit 12 of the respective air conditioning unit 206 that constitutes A/C #3. In this way, control subroutine SUB3 is executed until the target temperature TL is achieved, in which case A/C #3, A/C #2 and AC #1 are deactivated (steps S110*c*, S110*b* and S110*a*) and control is returned to the monitoring loop (loop 103). Alternatively, the target temperature TL is not achieved within the allotted maximum time interval Δtmax, in which case an alarm is activated (step S111). There is also an alarm deactivation step (step S112) upon exiting control subroutine SUB3 to make eliminate false alarms.

While the above example depicts control as being high gain, it would also be possible to control the respective air conditioners by using a variable speed drive and controller module operatively coupled with the modular control portion 34 of the respective master control unit 12 and with the compressors of the air conditioning units 206 in a proportional-type control scheme, such as discussed in Example 2 above.

In one embodiment, the first unit to gain a communications request upon powering up the system becomes the first designated master. The remaining units are slaved thereto in a sequence determined by the response of the respective slave unit to the communication request. Each master control unit 12 can be software configured to identify the number of units responding to the address query, to establish a schedule for rotation of the designated master function, and to share that schedule with the other master control units 12 that respond to the query. The sequence in which the units respond to the address query can determine an operational order for both the order of operation (i.e., which unit A/C #2 and which unit is A/C #3) and for the rotational order of the designated master schedule. Upon address initialization, each slave unit in sequence is put into sleep mode. By the rotation schedule, the designated master function is shared amongst the master control units 12. The slaved master control units follow each designated master control unit command without local control until the designated master control unit passes control to one of the slaved units pursuant to the rotation schedule or the communication link is lost.

Functionally, the use of multiple units form a single control loop enables greater dynamic capacity range. The criteria for passing control to the next master control unit on the schedule can be based on a fixed amount of elapsed time (hours or days), a fixed amount of accumulated run time (hours or days), or a fixed number of thermal cycles. Rotation of the designated master function distributes the wear on the units for extended maintenance/replacement cycles.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

For purposes of interpreting the claims for the present invention, it is expressly intended that the provisions of Section 112, sixth paragraph of 35 U.S.C. are not to be invoked unless the specific terms "means for" or "step for" are recited in the subject claim.

What is claimed is:

1. A method for proportional control of a thermostatically controlled residential air conditioning system, comprising:

providing a master control unit comprising a central microprocessor operatively coupled with a fixed task control portion and a modular control portion, said fixed task portion including a temperature measurement circuit operatively coupled with an indoor temperature sensor;

said modular control portion being operatively coupled with a first variable speed drive control module for control of a compressor of said residential air conditioning system, wherein said master control unit is configured for proportional-type loop control of a system capacity by manipulating a speed of said compressor with said first variable speed drive control module, said system capacity providing a process variable and said speed of said compressor providing a manipulated variable of said proportional-type loop control;

a set of computer-readable instructions stored in non-volatile memory for access by said central microprocessor, said computer-readable instructions including:

obtaining a desired time vs. indoor temperature set point schedule;

using said proportional-type loop control of said system capacity to dynamically reduce an OFF period of a duty cycle of said compressor, said OFF period being targeted at zero; and controlling said indoor temperature sensor in a closed loop to a controlled time vs. indoor temperature schedule.

2. The method of claim 1, wherein:

said fixed task controller of said master control unit provided in said step of providing includes a multiplexer connected to said temperature measurement circuit, said multiplexer being operatively coupled with said indoor temperature sensor as well as an inlet temperature sensor and an outlet temperature sensor, each of said inlet temperature sensor and said outlet temperature sensor being arranged to measure a temperature of a refrigerant entering and exiting an evaporator of said air conditioning system, respectively;

said modular control portion of said master control unit provided in said step of providing is operatively coupled with a second variable speed drive control module for driving a condenser fan of said residential air conditioning system; and said set of computer-readable instructions further include:

controlling a speed of said condenser fan to provide a temperature difference between said inlet temperature sensor and said outlet temperature sensor that is within a predetermined range of values.

3. The method of claim 1, wherein:

said fixed task controller of said master control unit provided in said step of providing includes a multiplexer connected to said temperature measurement circuit, said multiplexer being operatively coupled with said indoor temperature sensor as well at least one of an inlet temperature sensor and an outlet temperature sensor, each of said inlet temperature sensor and said outlet temperature sensor being arranged to measure a temperature of a refrigerant entering and exiting an evaporator of said air conditioning system, respectively;

said modular control portion of said master control unit provided in said step of providing is operatively coupled with a second variable speed drive control module for driving an evaporator fan of said residential air conditioning system; and said set of computer-readable instructions further include:

controlling a speed of said evaporator fan to provide a temperature level of said at least one of said inlet temperature sensor and said outlet temperature sensor to within a predetermined range of values.

4. The method of claim 1, wherein:

said programmable thermostat is external to said master control unit; and said desired time vs. indoor temperature set point schedule obtained in said step of obtaining a desired time vs.

indoor temperature set point schedule is provided by communication from said programmable thermostat.

5. The method of claim 4, wherein said communication from said programmable thermostat is sent over a digital communications link.

6. The method of claim 1, wherein:

said modular control portion of said master control unit provided in said step of providing is operatively coupled with a second variable speed drive control module for driving a condenser fan operatively coupled to a condenser of said residential air conditioning system; and said set of computer-readable instructions include:

controlling a speed of said condenser fan so that heat removal from said condenser is in proportion with said system capacity produced by said compressor.

* * * * *